United States Patent [19]

Deutsch et al.

[11] Patent Number: 4,495,847

[45] Date of Patent: Jan. 29, 1985

[54] COMBINED TONE GENERATION ON A SINGLE KEYBOARD FOR AN ELECTRONIC MUSICAL INSTRUMENT

[75] Inventors: Ralph Deutsch, Sherman Oaks; Leslie J. Deutsch, Sepulveda, both of Calif.

[73] Assignee: Kawai Musical Instrument Mfg. Co., Ltd., Hamamatsu, Japan

[21] Appl. No.: 506,468

[22] Filed: Jun. 21, 1983

[51] Int. Cl.[3] ..... G10H 1/00

[52] U.S. Cl. ..... 84/1.01; 84/1.19

[58] Field of Search ..... 84/1.01, 1.19, DIG. 2, 84/1.24

[56] References Cited

U.S. PATENT DOCUMENTS 4,402,245 9/1983 Oya et al. ..... 84/1.17

4,424,732 1/1984 Imamura et al. ..... 84/1.17

*Primary Examiner*—Forester W. Isen

*Attorney, Agent, or Firm*—Ralph Deutsch

[57] ABSTRACT

A keyboard operated electronic musical instrument is disclosed in which an independent monophonic tone synthesizer is operated from the same keyboard that controls the generation of tone from a polyphonic tone generation system. The highest frequency note is assigned to the monophonic tone synthesizer and all other actuated keyboard switches are assigned to the polyphonic tone generation system. The detection of the highest note is initiated each time that a keyswitch changes from an unactuated to an actuated state. An alternative arrangement is to assign the lowest frequency note to the monophonic tone synthesizer.

10 Claims, 6 Drawing Figures

COMBINED TONE GENERATION ON A SINGLE KEYBOARD FOR AN ELECTRONIC MUSICAL INSTRUMENT

BACKGROUND OF THE INVENTION

1. Field of the Invention

This invention relates to electronic musical tone synthesis and in particular is concerned with the simultaneous control of independent tone generators from a single keyboard.

2. Description of the Prior Art

Some of the current electronic muscial instruments are implemented with a conventional upper, or solo, keyboard as well as with a monophonic synthesizer which is keyed from an independent and separate synthesizer keyboard. In some of these instruments a means is provided so that the monophonic synthesizer can be played from the upper keyboard in combination with the tones that are also assigned to the upper keyboard. When this coupling mode is used each note keyed on the upper keyboard will cause a sound to be generated which corresponds to the tone controls selected for the upper keyboard. In addition, the highest frequency upper keyboard note will also act to produce the tone selected for the monophonic synthesizer keyboard. An important alternative arrangement is to have the highest frequency note keyed on the upper keyboard sound the monophonic synthesizer but not sound the tones selected for the upper keyboard.

A system is disclosed in U.S. Pat. No. 4,186,637 whereby one of a set of tone generators is designated as a solo high tone generator and is always utilized to produce the highest note that is sounded. The highest keyed note on the keyboard is simultaneously assigned to two tone generators operated at the same fundamental frequency. One of the generators is a member of the set of tone generators associated with the keyboard and the second is the dedicated solo high tone generator.

A system is disclosed in U.S. Pat. No. 4,342,248 for a keyboard operated electronic musical instrument in which in response to an actuated keyswitch a tone generator is assigned with a musical waveshape selected from a library of waveshapes which are ordered in a predetermined arrangement. The assignment of waveshapes is made in a priority order according to the musical frequencies associated with the actuated keyswitches so that a chorus effect is obtained in which each note of a group of simultaneous notes has its own tone color. The assignment of waveshapes is made in an adaptive manner so that the melody line retains its own distinctive sound even when the number of notes played simultaneously on a keyboard changes.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. A sequence of computation cycles is implemented during each of which a first master data set is created using a first set of harmonic coefficients which are selected by a first set actuated tone switches. At the end of each computation cycle, the computed first master data set is stored in a main register. Simultaneously with the computation of the first master data set, a second master data set is created using a second set of harmonic coefficients which may be time variant in magnitude. At the end of each computation cycle, the computed master data set is stored in a formant register.

Following each individual computation cycle, a transfer cycle is initiated during which the stored first master data set is transferred to a note register which is an element of each of a number of tone generators. The tone generators are assigned to actuated keyboard switches. A high note detector is used to detect the keyswitch corresponding to the current highest actuated note. The output from the high note detector is used to inhibit a transfer of the first master data set to a tone generator corresponding to the highest frequency note. The stored second master data set in response to the high note detector is transferred during the transfer cycle to a tone generator which is assigned to the highest frequency note.

The data stored in the note registers is sequentially and repetitively read out to a digital-to-analog converter at a rate corresponding to the fundamental frequency associated with its assigned actuated keyboard switch. The output tone generator continues uninterrupted during the computation and transfer cycles.

An object of the present invention is to provide a means for imitating the action of the combination of a conventional instrument keyboard in combination with a monophonic synthesizer imbedded in a tone generator system in which the number of tone generators is less than the number of keyswitches.

It is a further object of the present invention to provide a subsystem for combining a conventional keyboard tone generating system with a monophonic tone synthesizer such that the highest keyed note is assigned only to the systhesizer while the remainder of simultaneously actuated notes are assigned to the conventional tone generating system.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a polyphonic tone generator in which two independent tone generation systems are operated from a single keyboard such that all but the highest frequency note operates the first tone generation system and the highest frequency note operates the second tone generation system. The combination tone generating system is incorporated into a musical instrument of the type which synthesizes musical waveshapes by implementing a discrete Fourier transform algorithm. A tone generation system of this variety is described in detail in U.S. Pat. No. 4,085,644 entitled "Polyphonic Tone Synthesizer." This patent is hereby incorporated by reference. In the following description all elements of the system which are described in the referenced patent are identified by two digit numbers which correspond to the same numbered elements appearing in the referenced patent. System element blocks which are identified by three digit numbers correspond to system elements added to the Polyphonic Tone Synthesizer or correspond to combinations of several elements appearing in the referenced patent.

Figure 1:
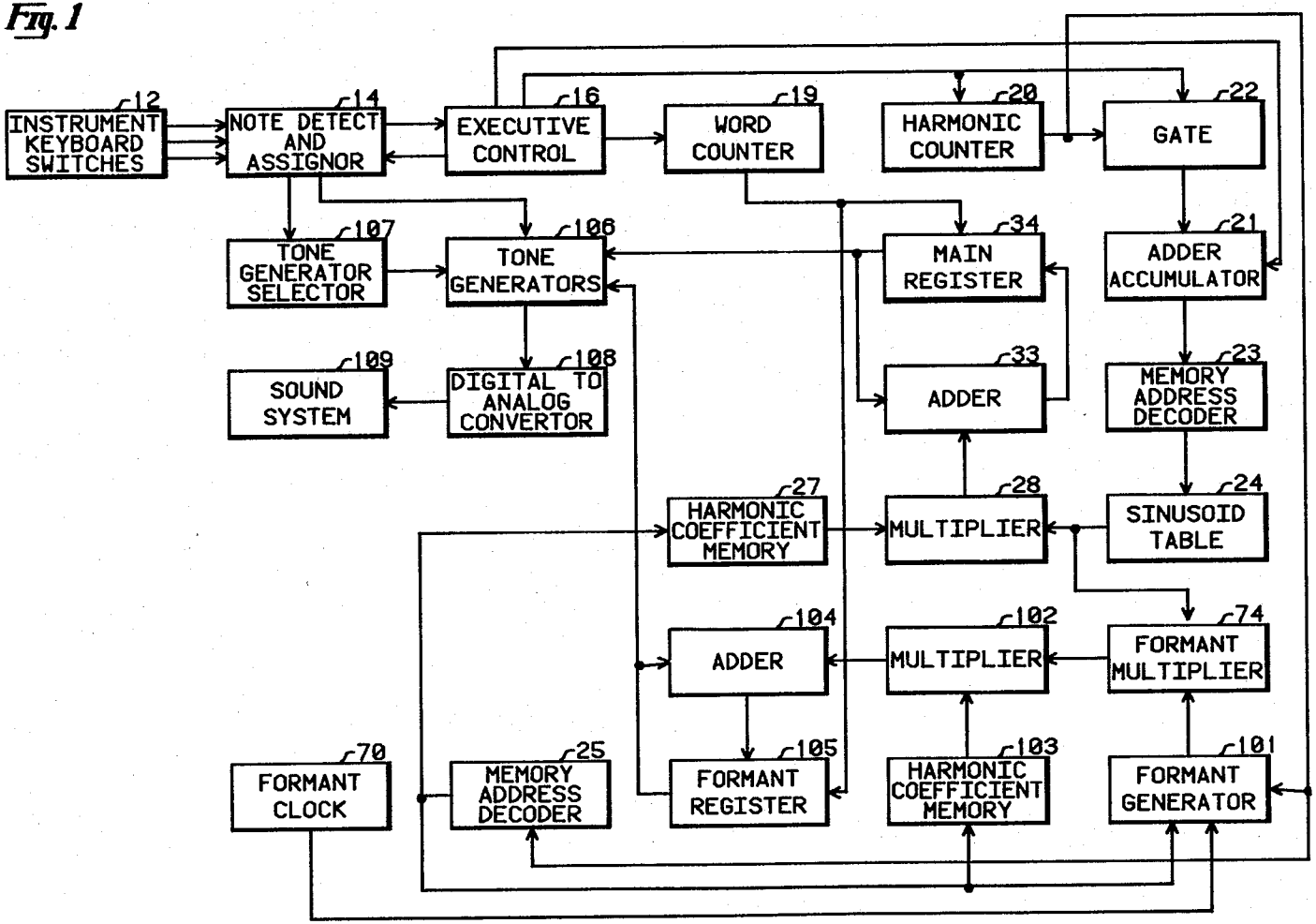
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of instrument keyboard switches 12. If one or more of the keyboard switches has a switch status change and is actuated ("on" position), the note detect and assignor 14 encodes the detected keyboard switch having the status change to an actuated state and stores the corresponding encoded note information for the actuated keyswitches. In a manner described below, one member of a set of tone generators, contained in the system block labeled tone generators 106, is assigned to each actuated keyswitch using information generated by the note detect and assignor 14 in combination with the tone generator selector 107.

A suitable note detect and assignor subsystem is described in U.S. Pat. No. 4,022,098 which is hereby incorporated by reference.

When one or more keyswitches have been actuated, the executive control 16 initiates a repetitive sequence of computation cycles. During each computation, a first and a second master data set each comprising 64 data words are computed in a manner described below. The first master data set is stored in the main register 34 and the second master data set is stored in the formant register 105. The 64 words of the first master data set are generated using a set of 32 harmonic coefficients which are stored in the harmonic coefficient memory 27. The 64 words of the second master data set are generated using a set of 32 harmonic coefficients which are stored in the harmonic coefficient memory 103.

The 64 data words in a master data set correspond to the amplitudes of 64 equally spaced points of one cycle of the audio waveform for the musical tone produced by a corresponding one of the tone generators 106. The general rule is that the maximum number of harmonics in the audio tone spectra is no more than one-half of the number of data points in one complete waveshape period. Therefore, a master data set comprising 64 data words corresponds to a maximum of 32 harmonics.

At the completion of each computation cycle in the repetitive sequence of computation cycles, a transfer cycle is initiated during which the first master data set residing in the main register 34 is transferred to each note register corresponding to the tone generators which have been assigned to an actuated keyswitch. Each tone generator has an associated note register. Also during the transfer cycle, the second master data set residing in the formant register 105 is transferred to a note register corresponding to a tone generator which is assigned to the actuated keyswitch corresponding to the current highest frequency note.

The master data set stored in a note register is read out sequentially and repetitively and transferred to a digital-to-analog converter at an addressing advance rate determined by a note clock associated with the note register.

A digital-to-analog converter is contained in the system block labeled digital-to-analog converter 108. The musical waveshape produced by the digital-to-analog converter 108 is transformed into an audible sound by the sound system 109 which contains a conventional amplifier and speaker subsystem.

As described in the referenced U.S. Pat. No. 4,085,644 it is desirable to be able to continuously recompute and store the generated master data sets during a repetitive sequence of computation cycles and to load this data into the associated note registers while the actuated keys remain actuated, or depressed, on the keyboards.

In the manner described in the referenced U.S. Pat. No. 4,085,644, the harmonic counter 20 is initialized to its minimal, or zero, count state at the start of each computation cycle. Each time that the word counter 19 is incremented by the executive control 16 so that it returns to its initial, or minimal, count state because of its modulo counting implementation, a signal is generated by the executive control 16 which increments the count state of the harmonic counter 20. The word counter 19 is implemented to count modulo 64 which is the number of data words in each of the two master data sets. The harmonic counter 20 is implemented to count modulo 32. This number corresponds to the maximum number of harmonics consistent with a master data set comprising 64 data words.

At the start of each computation cycle, the accumulator in the adder-accumulator 21 is intialized to a zero value by the executive control 16. Each time that the word counter 19 is incremented, the adder-accumulator adds the current count state of the harmonic counter 20 to the sum contained in the accumulator. This addition is implemented to be modulo 64.

The content of the accumulator in the adder-accumulator 21 is used by the memory address decoder 23 to access trigonometric sinusoid values from the sinusoid table 24. The sinusoid table 24 is advantageously implemented as a read only memory storing values of the trigonometric function $\sin(2\pi\phi/64)$ for $0 \leqq \phi \leqq 64$ at intervals of D. D is a table resolution constant.

The multiplier 28 multiplies the trigonometric value read out of the sinusoid table 24 by a harmonic coefficient read out from the harmonic coefficient memory 27. The memory address decoder 25 reads out harmonic coefficients from the harmonic coefficient memory 27 in response to the count state of the harmonic counter 20. The product value formed by the multiplier 28 is furnished as one input to the adder 33.

The contents of the main register 34 are intialized to a zero value at the start of a computation cycle. Each time that the word counter 19 is incremented, the content of the main register 34 at an address corresponding to the count state of the word counter 19 is read out and furnished as an input to the adder 33. The sum of the inputs to the adder 33 are stored in the main register 34 at a memory location equal, or corresponding, to the count state of the word counter 19. After the word counter 19 has been cycled for 32 complete cycles of 64 counts, the main register 34 will contain the first master data set.

The combination of the system elements contained in the blocks memory address decoder 25, harmonic coefficient memory 103, formant generator 101, formant multiplier 74, multiplier 102, adder 104, and formant register 105 operate to generate a second master data set which is characterized by having harmonics which are time variant. This second master data is used by an assigned tone generator to produce musical tonal effects which are called by the generic term of "tone synthesizer" or simply a "synthesizer."

The harmonic coefficient memory 103 stores a set of 32 harmonic coefficients which are used in the computation of the second master data which is used to create the synthesizer tone. Harmonic coefficients are read out from the harmonic coefficient memory 103 by the memory address decoder 25 in response to the count state of the harmonic counter 20.

Figure 5:
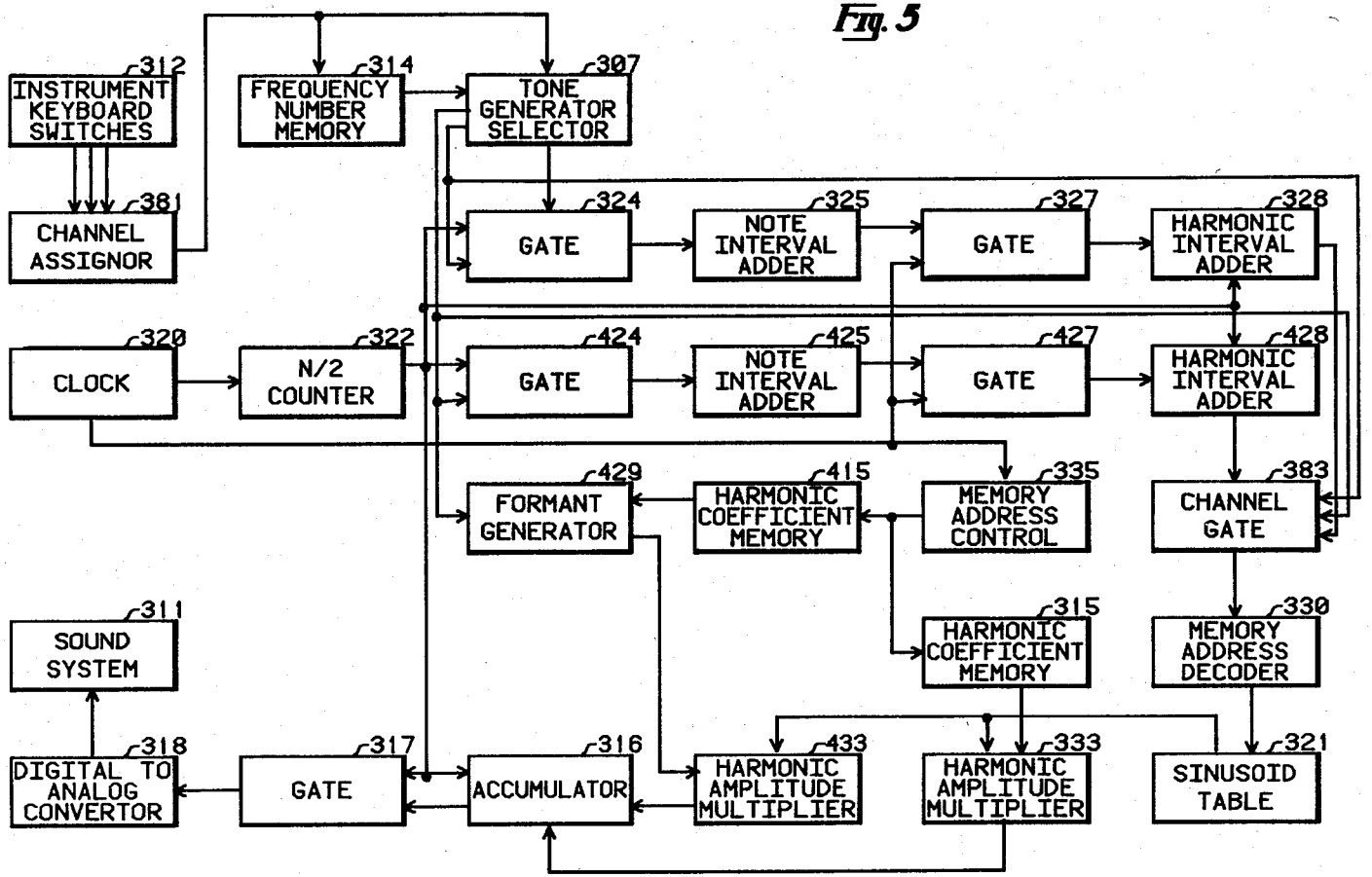
FIG. 5 is a schematic diagram of another embodiment of the invention.

The formant generator 101 provides a time varying set of amplitude factors in response to the count state of the harmonic counter 20 and the clock signals provided by the formant clock 70. The frequency of the formant clock is variable. The details of the formant generator are shown in FIG. 5 of the referenced U.S. Pat. No. 4,085,644.

The amplitude factors furnished by the formant generator 101 are used by the formant multiplier 74 to scale the sinusoid values read out of the sinusoid table 24. The multiplier 102 multiplies the harmonic coefficients read out from the harmonic coefficient memory 103 by the scaled sinusoid values produced by the formant multiplier 74. The product value formed by the multiplier 102 is furnished as one input to the adder 104.

The contents of the formant register 105 are intialized to a zero value at the start of a computation cycle. Each time that the word counter 19 is incremented, the content of the formant register 105 at an address corresponding to the count state of the word counter 19 is read out and furnished as an input to the adder 104. The sum of the inputs to the adder 104 are stored in the formant register 105 at a memory location equal, or corresponding, to the count state of the word counter 19. After the word counter 19 has been cycled for 32 complete cycles of 64 counts, the formant register 105 will contain the second master data set.

Figure 2:
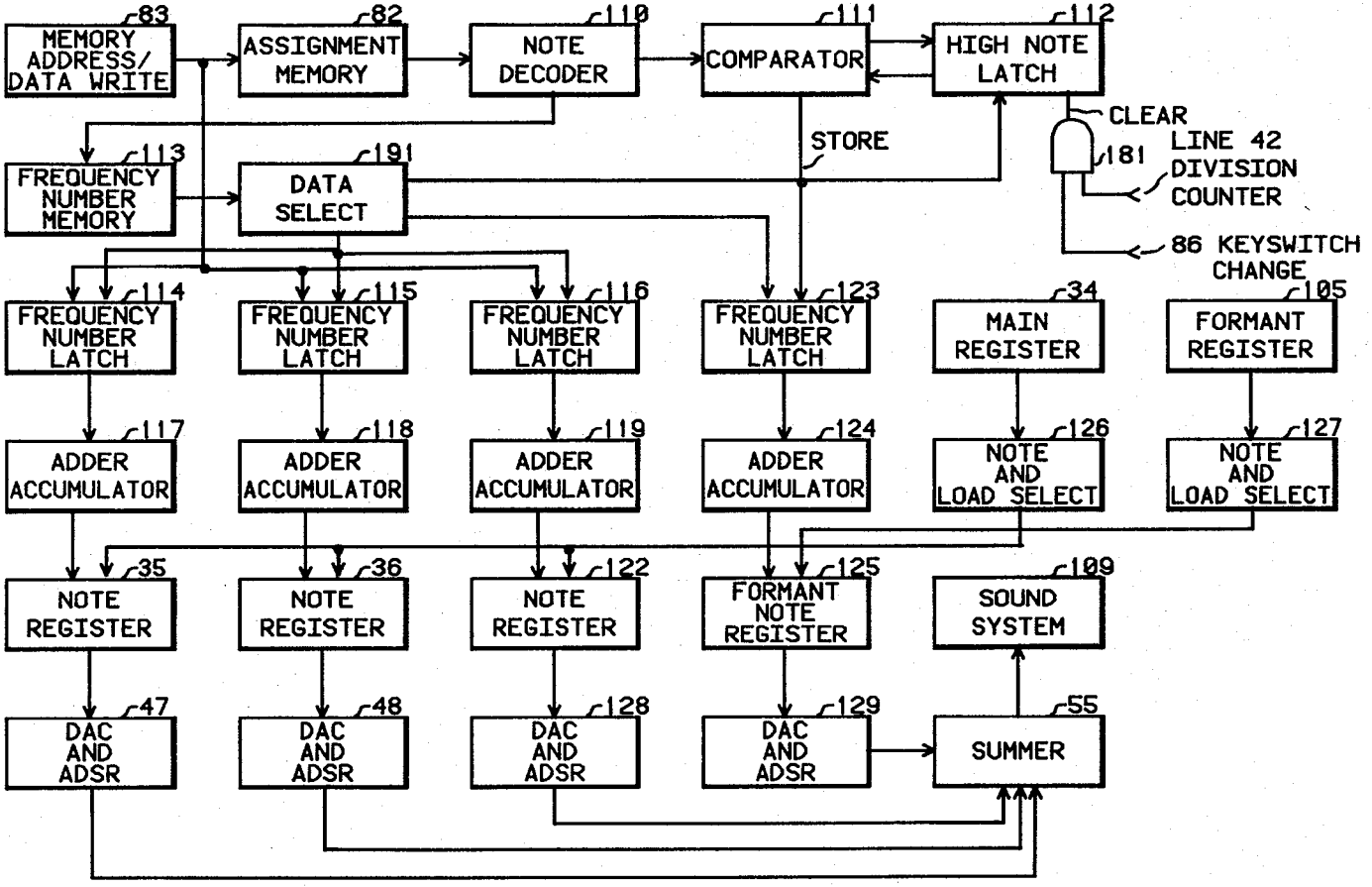
FIG. 2 is a schematic diagram of the tone selector.

FIG. 2 illustrates the logic details of the tone selector 107. The function of the tone selector 107 is to combine the tones governed by the first and second master data sets so that only the monophonic synthesizer tone corresponding to the second master data is automatically assigned to the highest frequency actuated keyboard switch.

As described in the referenced U.S. Pat. No. 4,022,098 the assignment memory 82 contains a plurality of data words each of which corresponds to a tone generator. Each of these data words has been encoded to denote the assigned status of the corresponding tone generator, the musical instrument's keyboard division, the octave within the keyboard's range, and the musical note within the octave.

The tone generator assignment data words are read out of the assignment memory 82 in response to addresses provided by the memory address/data write 83. The note decoder 110 decodes the assignment data words read out of the assignment memory 82 to form a keyboard note number $K_n$. The keyboard note number is formed by evaluating the expression $$K_n=(0_n-2).12=N_n. \qquad \text{Eq. 1}$$

$O_n$ is the octave number and $N_n$ is the note number for the n'th tone generator. The convention for note numbers is that the note C has the lowest value of N=1 and the note B has the highest value N=12. The octave number 0 for the lowest octave on an organ keyboard is 0=2.

The frequency number memory 113 is a read-only addressable memory containing frequency numbers in binary numeric form having the values $2^{-(M-K_n)/12}$ where the keyboard note number has the range of values $K_n=1,2,\ldots,M$ and M is equal to the number of keyswitches on the keyboard of the musical instrument. The frequency numbers represent the ratios of the fundamental frequencies in an equal tempered musical scale.

In response to a note number $K_n$ decoded by the note decoder 110, a frequency number is read out of the frequency number memory 113. The accessed frequency number is transmitted to the data select 191. If the STORE signal input to the data select 191 has a "0" binary logic state value, the input frequency number is made available to the set of frequency number latches 114 through 116 but is not made available to the frequency number latch 123. The frequency number latch, in the manner described below, is reserved to be used only to store the frequency number corresponding to the current highest frequency actuated keyswitch.

The particular one of the frequency number latches 114–116 that stores the current frequency number of the output of the data select is determined by the address data provided by the memory address/data write 83. If the STORE signal has a "0" logic level, then one of the frequency latches 114–116 will be given a zero value for the frequency number. The particular frequency latch that is given the zero valued frequency is the one that corresponds to the highest frequency actuated keyboard switch. A zero value frequency number effectively inhibits tone generation by its associated tone generator.

If a particular tone generator is to be unassigned, then the assignment memory 82 transmits an unassigned data word to the note coder 110 which in turn generates a zero value for the keyboard note number. A zero value of the keyboard note number in turn addresses out a zero valued frequency number from the frequency number memory 113.

An adder-accumulator in the set 117–119 is associated with one of the frequency number latches 114–116. The frequency number stored in the associated frequency number latch is repetitively added to the the contents of the accumulator in corresponding adder-accumulator. The six most significant bits of the content of an accumulator is used to address out stored first master data set values that are contained in the set of note registers 35, 36 and 122.

The first master data set values that are read out from a note register are converted into analog signals and amplitude scaled by means of a DAC (Digital-to-Analog converter) and ADSR (Attack/Decay/Sustain/Release) generator associated with each note register. All the individual analog signals are combined by means of the summer 55 and the resultant combination signal is provided to the sound system 109.

A suitable implementation for the ADSR generator is described in the U.S. Pat. No. 4,079,650 entitled "ADSR Envelope Generator." This patent is hereby incorporated by reference.

During the transfer cycle, which follows a computation cycle, the first master data set residing in the main register 34 is transferred in turn into each of the note registers 35, 36, 122 in the manner described in the referenced U.S. Pat. No. 4,085,644. The data transfer is accomplished in a manner which does not interfere with the tone generation produced by reading out master data set values from a note register.

During the transfer cycle, the second master data set residing in the formant register 105 is transferred to the formant note register 125 in a manner analogous to that by which the first master data set is transferred to the other note registers.

As described in the referenced U.S. Pat. No. 4,022,098 a "1" logic state signal is generated on line 42 by the division counter 63 (FIG. 2 of the patent) each time that the note detect and assignor 14 checks to determine the keyswitches status for the keyboard switches associated with the signal line 42. The note detect and assignor 14 generates a signal on line 86 (FIG. 2 of the patent) each time that a keyswitch status has changed. A status change may be either from an unactuated state to an actuated state (new "on" condition) or from an actuated state to an unactuated state (new "off" condition). If line 42 and line 86 both have a logic "1" binary signal state, then a CLEAR signal is generated by the AND-gate 181. In response to the CLEAR signal, the content of the high note latch is intialized to a zero value.

The comparator 111 compares the magnitude of the keyboard note number decoded by the note decoder 110 with the magnitude of a number stored in the high note latch 112. If the keyboard note number is greater than or equal to the number stored in the high note latch then the keyboard note number is stored in the high note latch 112 and the STORE signal is generated to have a "1" binary logic state.

In response to the STORE signal, the data select 191 will transfer the current frequency number read out from the frequency number memory to the frequency number latch 123. At the same time, as previously described, a zero-valued frequency number is placed in the frequency number latch corresponding to a tone generator for the first master data set which is assigned to the highest actuated keyboard switch. Since a zero-value for the frequency number cannot advance the memory address for a note register, only a constant single-valued signal can be produced by the tone generator. This constant value is readily removed by known techniques such a simple AC-signal coupling network.

The net result of the system logic described for the tone generator selector 107 is that the highest frequency actuated keyboard switch is assigned to the monophonic tone generator and the other tones are not generated at this highest frequency. A new test for the highest frequency is made every time it is determined that one of the keyswitches on the selected keyboard has had a keyswitch status change. If the highest note is released, then the system will automatically cause the next highest note to switch to the monophonic tone synthesizer.

Several alternative versions of the systems shown in FIGS. 1 and 2 are readily implemented. The monophonic tone synthesizer can be assigned to the lowest frequency note by changing the comparison logic implemented by the comparator 111. The comparator 111 is changed so that if the keyboard note number is less than or equal to the content of the high note latch 112, the STORE signal is generated. The CLEAR signal from the AND-gate 181 causes the content of the high note latch to be initialized to the highest possible keyboard note number.

By a modification of the data select 191, the highest frequency keyswitch can be made to simultaneously generate both tones. This is accomplished by preventing the STORE signal from causing a zero-valued frequency number to be furnished to the frequency number latches associated with note registers containing the first master data. Instead, the change causes the data select 191 to transmit the same current frequency number to the frequency number latch 123 as well as to the other set of frequency number latches.

The note detect and assignor system described in the referenced U.S. Pat. No. 4,022,098 provides a signal on a line 87 each time that a keyswitch state change has been detected for a transition from an unactuated to an actuated state. Thus a "1" binary logic signal on line indicates that a new keyswitch has been actuated on the keyboard. Line 87 can be substituted for line 86 as a signal provided to the AND-gate 181 shown in FIG. 2. This modification causes the high note detection subsystem to clear and search for a new high note only when a new keyboard switch has been actuated on the keyboard associated with line 42.

Figure 3:
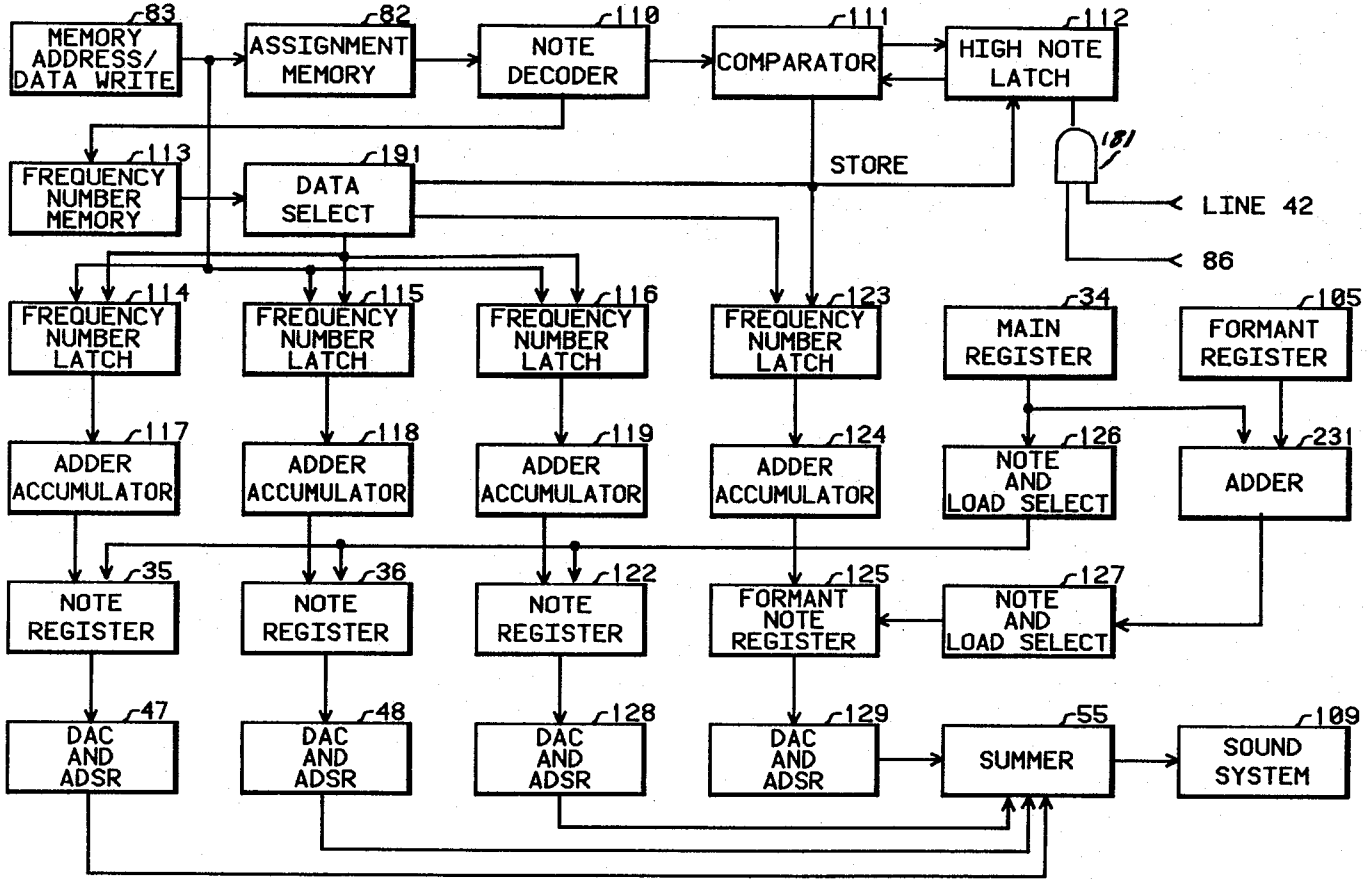
FIG. 3 is a schematic diagram of a combination tone generator.

FIG. 3 illustrates an alternative implementation in which a single tone generator is assigned to the highest actuated keyboard switch and simultaneously sounds both the monophonic synthesizer tone and the tones nomially assigned to actuated keyswitches on the same keyboard. The adder 231 is inserted so that the data loaded into the formant note register consists of a pointwise addition of the master data sets computed and stored in the main register 34 and the formant register 105.

Figure 4:
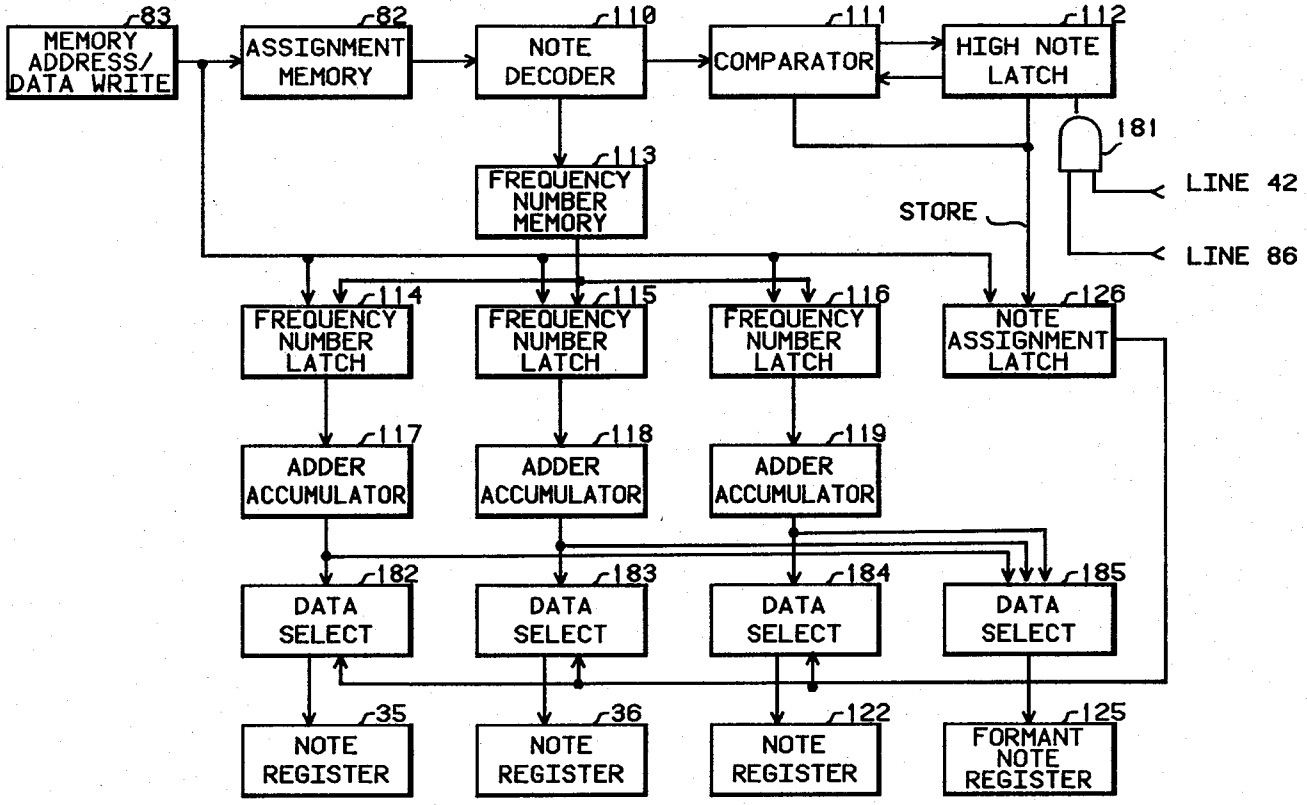
FIG. 4 is a schematic diagram of an alternate embodiment of the invention.

FIG. 4 shows an alternative version of the present invention. In this version a special dedicated tone generator is not permanently assigned to the monophonic tone synthesizer.

The comparator 111 operates in combination with the high note latch 112 to detect the keyboard note number corresponding to the current highest frequency actuated keyswitch on the keyboard corresponding to line 42. In response to the STORE signal generated by the comparator 111, the current memory address furnished by the memory address/data write 83 is stored in the note assignment latch 126.

A data select 181–184 is interposed between each adder-accumulator and its associated note register. The output six most significant bits of the set of accumulators are provided to the data select 185. In response to the stored data in the note assignment latch 126, the data select 185 selects the corresponding output from the accumulator. This data is used to read out the second master data set values which are stored in the formant note register 125.

The data stored in the note assignment latch 126 is used to inhibit the transfer of data from the associated one of the accumulators from reaching its corresponding note register. In this manner the highest frequency keyboard switch is assigned to the monophonic tone generator and is inhibited from generating a tone specified by the first master data set.

The present invention is not limited to tone generation systems of the type described in the referenced U.S. Pat. No. 4,085,644. FIG. 5 illustrates a system employing the present invention with the tone generation system described in U.S. Pat. No. 3,809,786 entitled "Computor Organ." This patent is hereby incorporated by reference. The system blocks shown in FIG. 5 are numbered to be 300 plus the corresponding block numbers shown in FIG. 1 of the referenced patent. The system blocks with 400 series numbers are counterparts to the same system blocks in the 300 number series.

A closure of a keyswitch contained in the instrument keyboard switches 312 causes the channel assignor 381 to access out a corresponding frequency number from the frequency number memory 314. The accessed frequency number and the output from the channel assignor 381 is used by the tone generator selector 307 to direct the frequency number to one of a set of tone generators. Two of the tone generators are shown explicitly in FIG. 4 starting with gate 324 and gate 424. In the manner previously described for the system shown in FIG. 1, the frequency number corresponding to the highest frequency actuated keyboard switch is furnished to the formant generator 429.

In each of the conventional tone channels, identified previously, the input frequency number provided to its associate gate (gate 324 or gate 424) is repetitively added to the contents of a note interval adder (note interval adder 325 or note interval adder 425). the content of a note interval adder specifies the sample point at which a waveshape amplitude is calculated. For each sample point, the amplitudes of a number of harmonic components are calculated individually by multiplying harmonic coefficient values read out of the harmonic coefficient memory 315 by trigonometric values read out of the sinusoid table 321. The multiplication is performed by the harmonic amplitude multiplier 333. The harmonic component amplitudes are summed algebraically in the accumulator 316 to obtain the net amplitude at a waveshape sample point. The sample point amplitudes are converted into an analog signal by means of the digital-to-analog coverter 318 and then the analog signal is furnished to the sound system 311.

The sinusoid table 321 stores values of the trigonometric function sin $(2\pi n/64)$. These function values correspond to a waveshape having 64 points per period for the highest fundamental frequency musical pitch generated by the system.

The polyphonic tone generation is accomplished by time sharing the functions previously described in a sequence of time slots. Each time slot corresponds to a detected actuated keyswitch and thus to an individual tone generator. The accumulator 316 sums the computation of points for one sequence of time slots and the resultant combined data point is furnished to the digital-to-analog converter 318.

Figure 6:
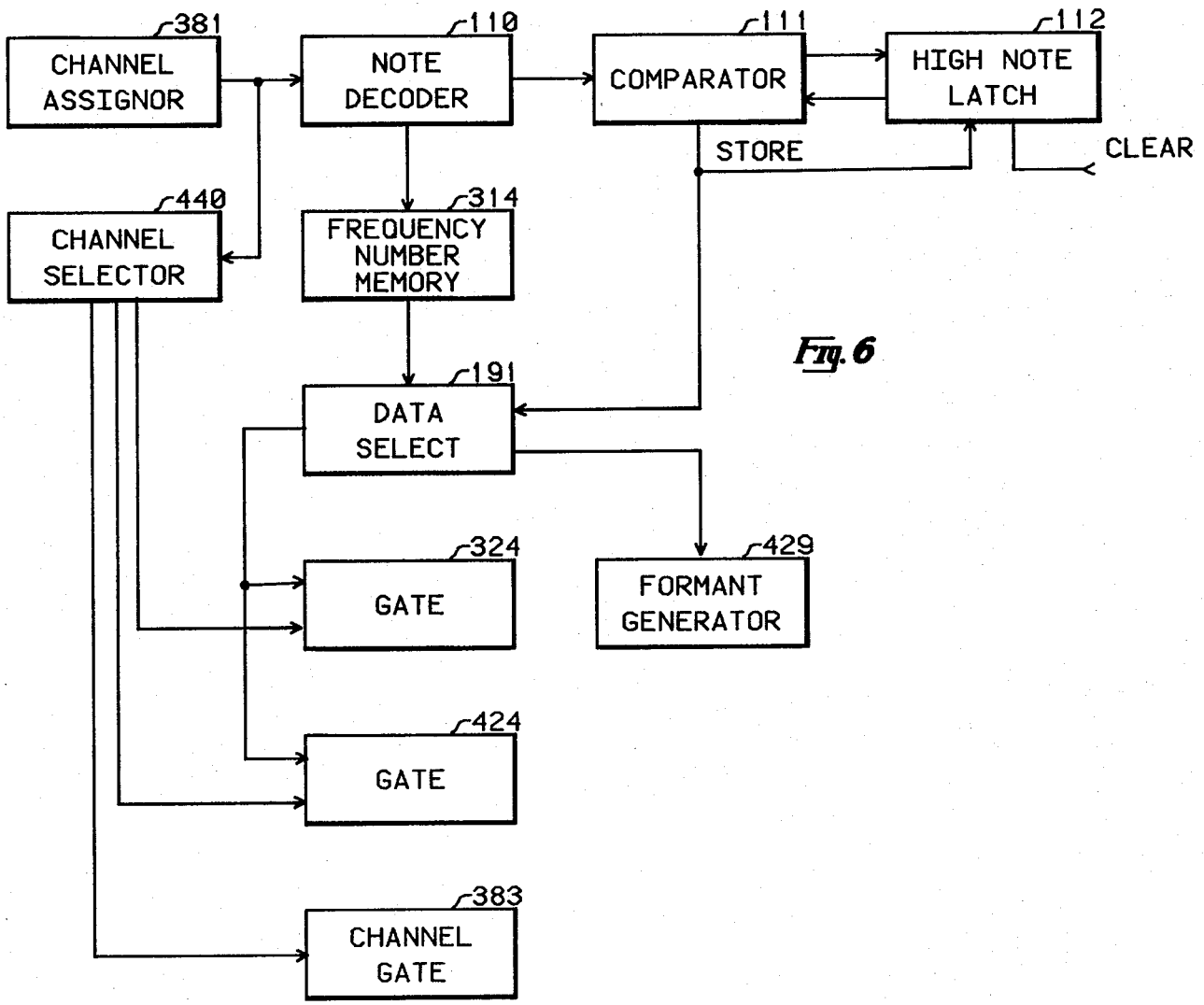
FIG. 6 is a schematic diagram of the tone generator selector 307.

FIG. 6 illustrates the details of the tone generator selector 307. The comparator 111 compares the keyboard note number furnished by the channel assignor 381 with a keyboard note number stored in the high note latch 112. The largest number, corresponding to highest frequency note of an actuated keyboard switch, is stored in the high note latch 112. As previously described in connection with the system shown in FIG. 2, the data select 191 furnishes the frequency number to the formant generator 429 corresponding to the highest frequency operated keyswitch. At the same time this highest frequency number is replaced by a zero value for the other tone generators represented by gates 324 and 424.

The detailed operation of the formant generator 429 is described in U.S. Pat. No. 3,956,960 entitled "Formant Filtering In A Computor Organ."This patent is hereby incorporated by reference.

We claim

1. In a musical having a first tone generator for producing a first preselected musical tone and having a plurality of second tone generators for producing a second preselected musical tone and in which said first and second tone generators are assigned to actuated keyswitches contained in a keyboard array of keyswitches corresponding to musical notes wherein each keyswitch is operable in an unactuated or in an acutated keyswitch state, apparatus for assigning the keyboard keyswitch corresponding to the highest frequency musical note to said first tone generator and for assigning all other actuated keyboard keyswitches to corresponding ones of said plurality of second tone generators comprising;

a note detection means for detecting the keyswitch states of keyswitches in said keyboard array of keyswitches and wherein a state change signal is generated each time that a keyswitch changes its keyswitch state and wherein a new note signal is generated corresponding to each keyswitch whose keyswitch state changes from an unactuated to an actuated keyswitch state, a high note detector which generates a high note data word identifying the keyswitch corresponding to the highest frequency of the actuated keyswitches only upon each occurrence of a said new note signal, and an assignor means responsive to said new note signal and responsive to said high note data word whereby said first tone generator is assigned only to the keyswitch identified by said high note data word and whereby all other keyswitches in an actuated state at the time of occurence of a said new note signal are assigned only to members of said plurality of second tone generators.

2. A musical instrument according to claim 1 wherein said note detection means comprises;

a note encoding means responsive to said new note signal whereby a keynote number is generated corresponding to each keyswitch which changes from an unactuated to an actuated keyswitch state, an assignor memory wherein each said keynote number is stored, and a memory addressing means for reading out said keynote numbers from said assignor memory.

3. A musical instrument according to claim 2 wherein said high note detector comprises;

a keynote decoding means responsive to said keynote numbers read out from said assignor memory whereby a keyboard note number which associates a musical tone frequency to a corresponding keyswitch is generated corresponding to each said keynote number, a high note memory for storing a high keyboard note number, a comparison means for comparing said keyboard note number stored in said high note memory with said keyboard note number generated by said keynote decoding means whereby a store signal is generated if the numerical value of said high keyboard note number is less than or equal to said keyboard note number generated by said keynote decoding means, and a memory writing means responsive to said store signal whereby said keyboard note number generated by said keynote decoding means is stored in said high note memory to become said high keyboard note number.

4. A musical instrument according to claim 3 wherein said high note memory comprises;

an initializing means whereby a zero value high keyboard note number is stored in said high note memory in response to said new note signal.

5. A musical instrument according to claim 3 wherein said note detection means further comprises;

a state detect means whereby a state change signal is generated for each keyswitch whose keyswitch state changes, and an initializing means whereby a zero value high keyboard note number is stored in said high note memory in response to said state change signal.

6. A musical instrument according to claim 3 wherein said assignor means comprises;

a frequency number memory storing a plurality of frequency numbers, a plurality of frequency number latches wherein one of said plurality of frequency number latches is associated with a corresponding one of said plurality of second tone generators and one of said plurality of frequency number latches is associated with said first tone generator, and a number addressing means responsive to said keyboard note number generated by said keynote decoding means whereby a frequency number is read out from said frequency number memory and stored in a corresponding one of said plurality of frequency number latches associated with said plurality of second tone generators and in response to said store signal is also stored in said frequency number latch associated with said first tone generator.

7. A musical instrument according to claim 6 wherein said assignor means further comprises;

a data select means interposed between said frequency number memory and said plurality of frequency number latches wherein in response to said store signal a zero value frequency number is stored in a frequency number latch corresponding to one of said plurality of second tone generators.

8. A musical instrument according to claim 6 wherein said first tone generator and said plurality of second tone generators comprises;

a first musical frequency means responsive to said frequency number stored in said frequency number latch corresponding to said first tone generator whereby said first tone generator produces a first preselected musical tone, and a plurality of second musical frequency means each of which is associated with one of said plurality of second tone generators whereby a second preselected tone musical tone is generated corresponding to the frequency number stored in said associated frequency number latch.

9. In a musical instrument having a first tone generator for producing a first preselected musical tone and having a plurality of second tone generators for producing a second preselected musical tone and in which said first and second tone generators are assigned to actuated keyswitches contained in a keyboard array of keyswitches corresponding to musical notes wherein each keyswitch is operable in an unactuated or in an actuated keyswitch state, apparatus for assigning the keyboard keyswitch corresponding to the lowest frequency musical note to said first tone generator and for assigning all other actuated keyboard switches to corresponding ones of said plurality of second tone generators comprising;

a note detection means for detecting the keyswitch states of keyswitches in said keyboard array of keyswitches and wherein a state change signal is generated each time that a keyswitch changes its keyswitch state and wherein a new note signal is generated corresponding to each keyswitch whose keyswitch state changes from an unactuated to an actuated keyswitch state, a low note detector which generates a low note data word identifying the keyswitch corresponding to the lowest frequency of the actuated keyswitches only upon each occurrence of a said new note signal, and an assignor means responsive to said new note signal and responsive to said low note data word whereby said first tone generator is assigned only to the keyswitch identified by said low note data word and whereby all other keyswitches in an actuated state at the time of occurrence of a said new note signal are assigned only to members of said plurality of second tone generators.

10. In a musical instrument having a first tone generator for producing a combination musical tone comprising a first and second preselected musical tone and having a plurality of second tone generators for producing said second preselected musical tone in which said first and second tone generators are assigned to actuated keyswitches contained in a keyboard array of keyswitches corresponding to musical notes wherein each keyswitch is operable in an unactuated or in an actuated keyswitch state, apparatus for assigning the keyboard keyswitch corresponding to the highest frequency musical note to said first tone generator and for assigning all other actuated keyboard keyswitches to corresponding ones of said plurality of second tone generators comprising:

a note detection means for detecting the keyswitch states of keyswitches in said keyboard array of keyswitches and wherein a state change signal is generated each time that a keyswitch changes its keyswitch state, and wherein a new note signal is generated corresponding to each keyswitch whose keyswitch state changes from an unactuated to an actuated keyswitch state, a high note detector which generates a high note data word identifying the keyswitch corresponding to the highest frequency of the actuated keyswitches only upon each occurrence of a said new note signal, a first generating means for creating a first waveshape data set corresponding to said first preselected musical tone, a second generating means for creating a second waveshape data set corresponding to said second preselected musical tone, a combination means whereby said first waveshape data set and said second waveshape data set are combined to form a combined waveshape data set, a first generation means for creating a musical tone in response to said combined waveshape data set, a plurality of a second tone generation means each of which creates a musical tone in response to said second waveshape data set, and an assignor means responsive to said new note signal and responsive to said high note data word whereby said first tone generation means is assigned only to the keyswitch identified by said high note data word and whereby all other keyswitches in an actuated state at the time of occurrence of a said new note signal are assigned only to members of said plurality of second tone generation means.

* * * * *